US006494921B1

(12) United States Patent
Bennett

(10) Patent No.: US 6,494,921 B1
(45) Date of Patent: Dec. 17, 2002

(54) METHOD OF REMOVING PARTICULATE DEBRIS, ESPECIALLY DUST MITE FECAL MATERIAL FROM FABRIC ARTICLES IN A CONVENTIONAL CLOTHES DRYER

(76) Inventor: M. Catherine Bennett, 14436 Kings Grant St., Gaithersburg, MD (US) 20878

( * ) Notice: Subject to any disclaimer, the term of this patent is extended or adjusted under 35 U.S.C. 154(b) by 0 days.

(21) Appl. No.: 09/501,229

(22) Filed: Feb. 10, 2000

(51) Int. Cl.[7] ..... D06F 37/00; D06F 58/22
(52) U.S. Cl. ..... 8/142; 8/137
(58) Field of Search ..... 8/137, 142

(56) References Cited

U.S. PATENT DOCUMENTS

| | | | | |
|---|---|---|---|---|
| 3,665,543 | A | | 5/1972 | Nappi |
| 4,208,696 | A | | 6/1980 | Lindsay et al. |
| 4,215,682 | A | | 8/1980 | Kubik et al. |
| 4,223,029 | A | | 9/1980 | Mahler et al. |
| 4,237,155 | A | | 12/1980 | Kardouche |
| 4,238,531 | A | | 12/1980 | Rudy et al. |
| 4,327,133 | A | | 4/1982 | Rudy et al. |
| 4,363,071 | A | | 12/1982 | Rzepecki et al. |
| 4,375,718 | A | | 3/1983 | Wadsworth et al. |
| 4,421,792 | A | | 12/1983 | Rudy et al. |
| 4,588,537 | A | | 5/1986 | Klaase et al. |
| 4,592,815 | A | * | 6/1986 | Nakao |
| 4,874,659 | A | | 10/1989 | Ando et al. |
| 4,904,174 | A | | 2/1990 | Moosmayer et al. |
| 4,917,942 | A | | 4/1990 | Winters |
| 4,977,142 | A | | 12/1990 | Green |
| 5,051,159 | A | * | 9/1991 | Togashi et al. |
| 5,057,710 | A | | 10/1991 | Nishiura et al. |
| 5,062,973 | A | | 11/1991 | Kellett |
| 5,066,413 | A | | 11/1991 | Kellett |
| 5,094,761 | A | | 3/1992 | Trinh et al. |
| 5,102,564 | A | | 4/1992 | Gardlik et al. |
| 5,122,048 | A | | 6/1992 | Deeds |
| 5,173,200 | A | | 12/1992 | Kellett |
| 5,179,840 | A | | 1/1993 | Worsfold |
| 5,238,587 | A | | 8/1993 | Smith et al. |
| 5,271,947 | A | | 12/1993 | Miller et al. |
| 5,348,667 | A | | 9/1994 | Bacon et al. |
| 5,376,287 | A | | 12/1994 | Borcher, Sr. et al. |
| 5,401,446 | A | | 3/1995 | Tsai et al. |
| 5,470,492 | A | | 11/1995 | Childs et al. |
| 5,476,599 | A | | 12/1995 | Rusche et al. |
| 5,503,756 | A | | 4/1996 | Corona, III et al. |
| 5,525,136 | A | | 6/1996 | Rosen |
| 5,552,378 | A | | 9/1996 | Trinh et al. |
| 5,578,234 | A | | 11/1996 | Corona, III et al. |
| 5,593,479 | A | | 1/1997 | Frey et al. |
| 5,630,848 | A | | 5/1997 | Young et al. |
| 5,632,780 | A | | 5/1997 | Siklosi |
| 5,647,881 | A | | 7/1997 | Zhang et al. |
| 5,658,651 | A | | 8/1997 | Smith et al. |
| 5,672,362 | A | | 9/1997 | Burnett |
| 5,747,053 | A | | 5/1998 | Nashimoto et al. |
| 5,834,386 | A | | 11/1998 | Cohen |
| 5,908,598 | A | | 6/1999 | Rousseau et al. |
| 5,916,917 | A | | 6/1999 | Suh et al. |
| 5,968,204 | A | * | 10/1999 | Wise |
| 5,970,556 | A | | 10/1999 | Nemoto |

OTHER PUBLICATIONS

Gaynor, PT and Hughes, JF (1998) Dust anchoring characteristics of electret fibres with respect to Der p 1 allergen–carrying particles. Med. Biol. Eng. Comp., 36, 615–620.

Gaynor, PT and Hughes, JF (1998) Electrostatic charge characteristics of Der p 1 allergen–carrying particles and the house dust mite dermatophagoides pteronyssinus. Med. Biol. Eng. Comp., 36, 351–354.

* cited by examiner

*Primary Examiner*—Margaret Einsmann

(57) ABSTRACT

A method is disclosed of removing particulate debris, including dust, dust mites and mite fecal material from non-washable items using webbing composed of any of the following: 1) fibers that have been treated in a manner such that they acquire a long-lasting electrostatic charge of any polarity (i.e., electret), or otherwise have an intrinsic electrostatic charge; 2), fibers that are charged electrostatically negative; 3) fibers that are capable of attaining a negative electrostatic charge with moderate agitation and friction, as with the tumbling agitation of an automatic clothes dryer; 4) fibers of at least two mixed types such that the fibers have an intrinsic, long-lasting embedded (electret) electrostatic charge with respect to each other, or are otherwise capable of acquiring such electrostatic charges in an environment of moderate agitation and friction (i.e., a clothes dryer), with the charges associated with at least two of the fiber types being of opposite electrostatic polarity with respect to one another, such that the fibers create a microenvironment for electrostatically retaining particulates by electrostatic attraction to either of the fiber types. A sheet composed of one of the above fiber types is placed into the drum of a conventional automatic clothes dryer along with the items to be cleaned. The rotation of the drum dislodges the dust, particulates, dust mites and fecal material into the drum, which then adhere to the fibrous sheets. The fibrous material of the dryer sheet also randomly contacts the articles as a result of the tumbling action and can electrically attract particulates from the surface of the fabric articles as well. Clothes dryer heat can also be applied within the drum during tumbling at a sufficient temperature to kill mites and eggs.

23 Claims, No Drawings

METHOD OF REMOVING PARTICULATE DEBRIS, ESPECIALLY DUST MITE FECAL MATERIAL FROM FABRIC ARTICLES IN A CONVENTIONAL CLOTHES DRYER

TECHNICAL FIELD

The present invention relates generally to dry cleaning processes and, more particularly, to methods of removing particulate debris, including dust mites and mite fecal material from non-washable items, using materials composed of fibers that have been treated in a manner such that they acquire a long-lasting electrostatic charge of any polarity, or comprised of fibers that are charged electrostatically negative, or are capable of attaining a negative electrostatic charge with moderate agitation and friction, as with the tumbling agitation of an automatic clothes dryer.

BACKGROUND ART

Most household products collect airborne particles, i.e. common household dust, and other soils. Common household dust provides the living and breeding environment for numerous living species, including Dermatophagoides Pteronyssinus, i.e., the house dust mite. Dust provides the carrier medium for dust mites and their fecal material. Dust mite fecal material is the carrier particle for the Der P1 antigen, a potent allergen implicated in initiating and aggravating numerous allergic reactions ranging from contact dermatitis to more serious atopic diseases such as allergic asthma.

Many common household items composed of domestic fabrics are not washable, either because of material composition, bulk or other factors. Examples of such items include stuffed toys, pillows, throw rugs and non-washable clothing.

Stuffed toys pose a particular hazard to children, as allergy-related illnesses have increased dramatically in the past several decades, and early exposure to allergenic antigens increases the risk of developing allergic diseases at some stage of life.

Accordingly, an object of the present invention is to remove dust, as well as dust mites and other micro-organisms that live and breed in household dust, dust mite fecal material and other micro-organism excrement, and various particulate soils from fabric surfaces.

Another object is to remove various types of soil from fabric articles in a conventional automatic clothes dryer.

Still another object is to remove dust mites and mite fecal material from stuffed animals or figures in an inexpensive process that can be practiced at home.

Yet a further object is to remove dust mites and other forms of soil from fabric articles such as stuffed animals utilizing electrically charged sheets in a conventional automatic clothes dryer.

DISCLOSURE OF THE INVENTION

The present invention is a method of cleaning a surface of at least one fabric article, comprising the steps of placing a soiled one of the fabric articles in a chamber, together with an electrically charged material having either a permanent electrostatic charge, or a long-lasting charge, or an electronegative charge acquired during movement, or a charged material having a mixed charge, and then moving the chamber to impart motion to the fabric article and enable the material to electrically attract particulates from the article.

In the preferred embodiment, the electrostatically charged material is a non-woven webbing comprised of electret fibers, in sheet form, that is tossed loose into the drum of a clothes dryer, together with one or more preferably dry fabric articles to be cleaned. The articles may be one or more stuffed toys, pillows, throw rugs or other non-washable fabric items. The articles may also be washable items that were previously washed and now deposited into the dryer in wet condition. The drum of the clothes dryer is operated under conventional usage conditions involving rotation of the dryer drum and preferably, but not necessarily, the introduction of hot air into the drum. The attraction and trapping of dust, mites, mite fecal material and/or other particulates is accomplished by dryer tumbling and/or frictional agitation or the combined action thereof, which mechanically dislodges some of the particulates, and the repetitive frictional contact of the sheet against the objects being cleaned. The sheet of electret then acts as an electostatic trap to attract and retain the dislodged particles.

The use of electrostatically negative charged electret fibers is of particular advantage for the trapping of dust mite fecal material, while negative, positive and mixed electret fibers are efficient at trapping dust and other particulates. Electret has been demonstrated to be at least two-fold more efficient for dust attraction and retention than comparable non-electret fibers and, under optimal conditions, more than ten-fold more efficient.

The feature of removing dust mite fecal material from stuffed animals and other fabric articles advantageously provides an effective and simple method of mitigating antigens that have been demonstrated to induce, trigger and exacerbate allergic asthma in some children and infants. The method can be practiced at home simply by placing one or more stuffed animals in the drum of a conventional clothes dryer together with a sheet of electret material and then operating the dryer in a conventional manner. The dryer may be operated using air of the ambient temperature, or heated air can be introduced either prior to, or concurrent with, the placement of the electret sheet into the dryer drum. The advantage of using heated air is that exposure of dust mites to temperatures of at least 55 degrees C. for at least 15 minutes kills the mites and their eggs. The introduction of the electret sheet after heating the fabric items has the advantage of reducing the amount of charge leakage that can sometimes occur with electret exposure to heat and eliminate the possibility of softening the electret fibers.

Although the use of sheets of material containing electret fiber is the preferred choice as disclosed in the preferred embodiment, it is also possible to practice the invention and achieve the benefits thereof using other types of electrically charged materials. Another preferred embodiment is to use material composed of fibers that have an intrinsic negative electrostatic charge, or are capable of developing an electrostatic negative charge in an environment of moderate agitation (i.e., the operating dryer drum). Fibers having an intrinsic or acquired electronegative charge are then capable of attracting particulates that have a positive charge with respect to these fibers. These fibers would act as an attractant for dust and particulates, and would be especially effective as an attractant and trap for dust mite fecal material.

Another embodiment of the present invention is a sheet of at least two (2) types of fibers, with one of the fiber types being more electronegative than the other type within the triboelectric series. Such fibers (e.g., electret) would have either an intrinsic voltage difference between them, or would develop such a voltage differential in the operating environment of the dryer. The voltage differential in the microenvironment of the fiber matrix would facilitate the electrostatic trapping of particles charging either positive or negative against either of the fiber types.

It is also within the scope of the present invention, in yet a further embodiment, to provide a method of cleaning a surface of at least one fabric article comprising the steps of placing a soiled one of the articles in a drum of a conventional automatic clothes dryer and then placing an electrostatically charged material of any of the types described above in a lint trap located in an air passage between the drum and outside atmosphere. The dryer is then operated by rotating the drum in a conventional manner. This enables the soil discharged from the at least one fabric article to be carried in the air efflux through the electrically charged material in the lint trap so as to enable the dislodged soil to be electrically attracted and trapped within the charged material.

It is also within the scope of this invention to use electret material for dusting by moving the electret relative to and in contact with a surface being dusted.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the description is to be regarded as illustrative in nature, and not as restrictive.

BEST MODE FOR CARRYING OUT THE INVENTION

The present invention is premised on the recognition that dust mite fecal material (the Der P1 carrier particle) carries a strong net electropositive charge in environments of moderate physical agitation. The charge that these particles carry is strongly electropositive against most all dielectrics in the triboelectric series. The triboelectric series is a ranking of materials from positive to negative. Materials appearing more negative in the series usually develop a negative charge relative to those more positive in the series, and conversely, those more positive in the series develop an electropositive charge relative to those more negative in the series.

Some dielectric materials are capable of being processed by various methods such that a semi-permanent electrostatic charge is applied to the material. Materials that acquire a long-lasting electric charge are called "electrets" An electret, a counterpart to a magnet, is a dielectric material that exhibits a permanent electric field or stores permanent charges without requiring an externally applied voltage. In the current technology the charge applied to dielectric material to make electrets can be applied in various manufacturing methods by using one of two basic charging processes: field charging or remote charging. Materials may be charged electrostatically positive, negative or fibers of both polarities may be blended (e.g., split film fiber). The media to be charged can be of various manufactured forms, including melt-blown, needle punch and split-film fiber. Numerous patents have been issued for various charge application processes and electret material preparation, including the following: U.S. Pat. Nos. 5,122,046; 4,904,174; 4,215,682; 4,592,815; 5,051,159; 4,375,718; 4,588,537; 5,401,446; 4,874,659 and 5,057,710, the disclosures of which are hereby incorporated by reference herein in their entireties.

Surface potentials of electrets can range from several thousand volts to <10 V, with typical voltages being in the range of several hundred volts. Dust trapping efficiency is not necessarily affected dramatically by a drop in surface voltage, which can occur, for example, by wetting electret fibers, because most deep interior charges remain. Charge dissipation, or leakage, can be thermally stimulated in polypropylene electret, for example, at temperatures of 137 degrees C., though dust trapping properties are affected only modestly and measured surface voltage may actually increase, probably due to charge migration from interior to surface. These temperatures are typically higher than those achieved in a conventional automatic clothes dryer.

Specifically, the present invention preferably utilizes a webbing (typically nonwoven but may be woven) of electret fibers, which are charged negative, charged positive, or the webbing may be comprised of a mixture of positive and negative charged fibers, to serve as an attractant and trap for dust, dust mites and other dust-dwelling microorganisms, fecal material of mites and other organisms, and other particulate debris, for use in a conventional automatic clothes dryer.

In another embodiment, the present invention uses fibers that are electronegative in the triboelectric series with respect to most common domestic fabrics, such that the fibers develop an electronegative charge in the moderate agitation of the rotating dryer drum and the friction of fiber to fiber contact.

In yet another embodiment, the webbing would be comprised of two or more mixed fibers, some capable of developing a positive charge and others capable of developing a negative charge with respect to one another, thus creating a microenvironment capable of attracting and holding particulates that have either positive or negative charges with respect to one or the other fiber type.

The overall object of the various forms of the present invention is to remove various particulate debris from non-washable fabrics using a cloth or sheet comprised of the aforementioned materials in a conventional automatic dryer. It is a further object to remove efficiently dust mite fecal material, which carries the Der P1 allergen, from non-washable fabrics such as stuffed toys. The Der P1 carrier particle (dust mite fecal material) has been shown to have a strong electrostatic positive charge in an environment of moderate agitation relative to materials that are both highly electronegative (e.g. polypropylene) and highly electropositive (nylon) in the triboelectric series. Thus, mite fecal material has been concluded to be highly electropositive and is attracted to materials that have an electronegative charge with respect to it.

More specifically, the present invention is comprised of a non-woven webbing of electret polymer fibers that have been embedded with a long lasting electrostatic charge, formed into a sheet (other shapes may be used, such as a ball or sponge shape) or cloth for use in a conventional dryer. The electret may be comprised of a fibers of various types, e.g., melt-blown, needle punch, split fiber. This list is meant to be illustrative but not exhaustive and the method of electret production is not to be taken to be limited to the methods currently available for generating electret. Depending upon the sheet thickness, the webbing may or may not be attached to a backing sheet such as spun bond to provide support and tensile strength. One or more soiled articles, preferably dry, are placed into the dryer along with the sheet. This step may be preceded by a dry heat agitation of the articles to be cleaned, or the dry heat introduction may be concurrent with the introduction of the dryer sheet.

Sheets of electret fibers are placed into the dryer drum, along with the articles to be cleaned, and the dryer is operated either with or without heated air. The electret sheet attracts dust, dust mites and their fecal material, and other particulate debris both by electrostatic attraction, which results in the particle adherence to the electret fibers, and by the mechanical trapping of said particulates between the fibers of the webbing. The trapping of particles is aided by the mechanical tumbling action of the dryer drum, which aids in dislodging of debris from fiber surfaces. Additionally, debris is attracted to the electret by the repetitive contact of the electret sheet with the fabric surface. The electret sheet acts as an attractant and trap for dislodged particulates.

As a result of reviewing the present specification, persons skilled in the art will be able to identify an appropriate density of electret fibers in a carrier sheet in order to achieve a desired dust saturation ratio based upon the flow of air caused by air circulating in a dryer drum through a sheet of electret material of predetermined thickness.

Generally speaking, electret fibers can hold approximately their own weight in dust particles and retain 95% of this dust in the face of a mild vacuum induced air flow. This represents an at least two- to greater than ten-fold (under optimal conditions) retention of particles than non-charged fibers. Heat may induce some charge relaxation, (i.e., leakage) but retention is still much higher (even after heat induced charge relaxation, electret retains approximately 74%–99% of initial dust applied) than that of non-charged fibers.

If one assumes that an average stuffed animal has approximately 100 square inches of surface (e.g., assuming a toy 10"×5" in estimating an area of front and back as 50 square inches each), and if the soiling factor is 4:1, a 10"×10" sheet of material comprising electret fibers weighing about 3 grams can be expected to hold approximately 3 grams of dust, which is the amount of dust calculated to be held by four very dusty stuffed toys of approximately 100 square inches of surface each. Thus, for the sake of example, it is believed that a 10"×10" sheet of electret fibers having the aforementioned weight characteristics can be expected to clean approximately 400 square inches of dusty toys, and perhaps more depending on the degree of dust. These estimates are meant to be illustrative rather than precise.

The electret sheets employed in accordance with the present invention are preferably dry and do not include any chemicals or compositions of matter providing fragrance or other cleaning benefits when used in a dryer environment. However, the electret or other charged sheets provided in accordance with the invention may be treated with miticides (mite killing agents) such as (1) disodium octaborate tetrahydrate (DOT)—5% in aqueous (water) solution; (2) benzyl benzoate (or benzyl alcohol) 0.1–10% in aqueous solution; (3) tannic acid solution in water—may include also ethanol and benzyl alcohol; (4) Eucalyptus oil in water. When the sheets are treated with miticides, it may be unnecessary to utilize the sheets in a heated dryer environment and thereby avoid the potential problem of charge relaxation under heat induced conditions. However, it is within the scope of the invention to use both miticides and heat in practicing this invention.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A method of cleaning a surface of at least one fabric article, comprising the steps of:

(a) placing a soiled one of said at least one fabric article in a chamber, together with electret; and (b) moving the chamber to physically agitate the fabric article and enable the material to electrically attract soil from said article.

2. The method of claim 1, wherein said chamber is a drum of a conventional automatic clothes dryer.

3. The method of claim 2, wherein said dryer is operated to rotate said drum.

4. The method of claim 1, wherein the electret, attracts soil from said article by repetitively contacting said surface and by attracting said soil already dislodged from said article's surface as a result of the tumbling action.

5. The method of claim 1, wherein said soil is at least one of dust mites, dust mite fecal material, the Der P1 allergen, other microorganisms, other excrement and particulates, and other dry particulate-based debris.

6. The method of claim 1, wherein said fabric article is a stuffed toy, a stuffed figure, pillows, throw rugs, and/or non-washable fabric articles.

7. The method of claim 3, comprising the further step of applying heat to ambient atmosphere within said rotating drum.

8. The method of claim 1, wherein said electret is in at least one of a sheet form, a ball, and a sponge.

9. The method of claim 1, wherein said electret is a negatively charged material.

10. The method of claim 9, wherein said soil is at least one of dust mites, dust dwelling microorganisms, and excrement of said mites or organisms.

11. A method of cleaning a surface of at least one fabric article, comprising the steps of:

(a) placing a soiled one of said at least one fabric article in a chamber, together with an electret material having a negative charge; and (b) moving the chamber to enable the material to electrically attract a predetermined type of soil from said article.

12. The method of claim 11, wherein said chamber is a drum of a conventional automatic clothes dryer.

13. The method of claim 11, wherein said dryer is operated to rotate said drum.

14. The method of claim 11, wherein the electret attracts said soil from said article by repetitively contacting said surface and by attracting said soil already dislodged from said article's surface as a result of the tumbling action.

15. The method of claim 11, wherein said soil is at least one of dust mites, dust dwelling microorganisms, and excrement of said mites or organisms.

16. The method of claim 11, wherein said fabric article is a non-washable item in the form of at least one of a stuffed animal toy, pillows, and throw rugs.

17. The method of claim 11, comprising the further step of applying heat to ambient atmosphere within said rotating drum.

18. A method of removing dust mites from a stuffed toy, comprising the steps of:

(a) placing the stuffed animal in a drum of a conventional automatic clothes dryer, together with an electret material having a negative electric charge; and (b) operating the dryer by rotating the drum to enable the material to electrically attract at least one of said dust mites, dust dwelling microorganisms, and excrement of said mites or organisms from said stuffed toy.

19. The method of claim 18, wherein said electret has a permanent negative charge.

20. The method of claim 18, comprising the further step of applying heat at a sufficient temperature to kill at least one of dust mites, dust dwelling microorganisms, and excrement of said mites or organisms within the rotating drum.

21. The method of claim 18, wherein the electret electrically attracts said soil from said article by repetitively contacting said surface and by attracting said soil already dislodged from said article's surface as a result of the tumbling action.

22. A method of cleaning a surface of at least one fabric article, comprising the steps of:

(a) placing a soiled one of said at least one fabric article in a drum of a conventional automatic clothes dryer;

(b) placing an electret material in a lint trap located in an air passage between said drum and outside atmosphere; and (c) operating the dryer by rotating the drum to enable material discharged from the at least one fabric article to be carried in the air efflux of the dryer through the permanently electrically charged material in the lint trap so as to enable the dislodged soil to be electrically attracted and trapped within said permanently charged material.

23. The method of claim 22, wherein said electret material is applied in sheet form in the lint trap.

* * * * *